US005362265A

United States Patent [19]

Gervais

[11] Patent Number: 5,362,265

[45] Date of Patent: Nov. 8, 1994

[54] MARINE ENGINE FLUSHING APPARATUS AND METHOD

[76] Inventor: Mark Gervais, 62 Binswood Avenue, Toronto, Ontario, Canada

[21] Appl. No.: 60,806

[22] Filed: May 12, 1993

[51] Int. Cl.[5] ..... B63H 21/10

[52] U.S. Cl. ..... 440/88; 440/900

[58] Field of Search ..... 440/88, 900, 113; 134/166 R, 167 R, 168 R, 169 A, 172, 198, 199; 165/95; 123/179.2, 179.3, 179.1, 179.5

[56] References Cited

U.S. PATENT DOCUMENTS

| | | | |
|---|---|---|---|
| 3,931,828 | 1/1976 | Lawler | 134/167 R |
| 4,246,863 | 1/1981 | Reese | 440/88 |
| 4,276,914 | 7/1981 | Albertson | 134/169 A |
| 4,336,918 | 6/1982 | Karbo | 251/46 |
| 4,359,063 | 11/1982 | Carlson | 134/167 R |
| 4,540,009 | 9/1985 | Karls | 134/167 R |
| 4,877,043 | 10/1989 | Carmichael et al. | 134/169 A |
| 4,973,276 | 11/1990 | Mavrelis | 440/113 |
| 4,991,608 | 2/1991 | Schweiger | 134/169 A |
| 5,051,104 | 9/1991 | Guhlin | 440/88 |
| 5,071,377 | 12/1991 | Saunders et al. | 440/88 |
| 5,090,458 | 2/1992 | Creeron | 134/169 A |

*Primary Examiner*—Edwin L. Swinehart

*Attorney, Agent, or Firm*—Flehr, Hohbach, Test, Albritton & Herbert

[57] ABSTRACT

An apperatus and method for flushing a marine engine (3) which is both the flow of fluid to the marine engine (3) and the starting of the engine. The apparatus employs a conduit (14) coupled to a fluid supply (1) for supplying fluid to the marine engine (3). A valve assembly (2) is mounted to the conduit (14) between the fluid supply (1) and the cooling inlet port (2) and controls the flow of fluid to the cooling inlet port (2). The valve assembly (2) is responsive to a start signal to permit the flow of fluid; and a switch assembly (4) is electrically coupled to the valve assembly (2) and to the marine engine (3) for providing the start signal to the valve assembly (2) to allow the fluid to flow and an engine signal to the marine engine (3) to enable starting of the engine.

12 Claims, 3 Drawing Sheets

MARINE ENGINE FLUSHING APPARATUS AND METHOD

TECHNICAL FIELD

This invention relates generally to flushing debris and saltwater from marine engines, and more particularly, it relates to controlling both the flow of fluid to flush the marine engine and starting of the marine engine during the flushing procedure.

BACKGROUND ART

When marine engines are removed from the water for transportation, storage or maintenance purposes, the marine engine may contain saltwater and/or debris such as sand, slit, mud or alkalis. The saltwater and debris, accumulated during use, have corrosive effects on the marine engine's parts. Therefore, the saltwater and debris must be flushed from the marine engine to prevent corrosion.

In order to accomplish the internal cleaning of such marine engines, the general procedure is to force clean or fresh water in through the cooling inlet port of the marine engine. During operation in a marine environment, water is taken into the cooling inlet port to cool the engine. By forcing the cleaning water through the engine in this fashion, cleansing or removal of saltwater and/or debris from the working parts of the engine is accomplished.

Numerous prior art devices are in existence and are commercially available which are designed to secure a supply of cleansing fluid to the marine engine cooling inlet port so that the cleansing fluid will be driven through the engine in the manner described above. These devices and/or assemblies take many forms and are generally represented in the following: U.S. Pat. No. 4,359,063 to Carlson, issued Nov. 16, 1982; U.S. Pat. No. 4,071,377 to Saunder et al., issued Dec. 10, 1991; U.S. Pat. No. 4,973,276 to Maurelis, issued Nov. 27, 1990; U.S. Pat. No. 4,246,863 to Reese, issued Jan. 12, 1981; and U.S. Pat. No. 3,931,828 to Lawler, issued Jan. 13, 1976.

As is the case with all of the flushing accessories cited above, the user is required to return to the source of the water supply (which is often remote) each time the operator wishes to initiate or terminate the flow of fluid. Additionally, the user must turn the engine ignition "on" and "off" at the ignition switch to start and stop the marine engine. This is especially true for maintenance procedures requiring the intermittent operation of the marine engine.

This repetitious process is particularly inefficient in a large shop or boat yard environment where it may be impractical to orient the entire vessel or move the marine engine close to a fluid supply. This repetitious process required by the flushing accessories described above has numerous deficiencies. First, the act of the operator having to return to the fluid supply each time he wishes to initiate or terminate the flow of fluid is appreciably time consuming. In a shop environment, this inefficiency translates into increased costs to the shop owner and ultimately the consumer.

Second, once the flow of fluid is initiated, the fluid will flow through the marine engine continuously until it is terminated at the fluid supply. It follows that even the most conscientious operator must allow the fluid to flow unnecessarily through the marine engine before and after his maintenance procedure for as long as it takes him to return to the fluid supply source. Furthermore, during maintenance procedures that require the intermittent operation of the marine engine, it is often impractical to terminate the flow when the engine is stopped and re-initiate it when the engine is restarted. The result being that more often than not, water is wastefully allowed to flow for the entire time it takes to complete the maintenance procedure.

Third, there also exists the possibility that during procedures which require the repetitive intermittent operation of the marine engine, and subsequent intermittent operation of the water flow, an operator may inadvertently forget to initiate the fluid flow, thereby potentially causing severe damage to the marine engine. Because of the orientation of the engine, ignition switch, lower drive unit, water supply source, water inlets and exhaust ports relative to each other, the flow of fluid may not be readily ascertainable to the operator which heightens the risk. This separation of key components is common when performing maintenance procedures or flushing procedures on marine engines that are not removed from the vessel which they propel.

The apparatus and method of the present invention provides a novel, highly reliable marine engine flushing system. The unique combination of a flushing accessory, solenoid switched valve, and electronic switch allows control over both the flow of cleansing fluid to the marine engine and the starting of the marine engine from a single convenient location. Thus, the present invention eliminates the inefficient use of fluid resources, increases the productivity of the operator and reduces the potential for running the marine engine without the necessary coolant.

DISCLOSURE OF THE INVENTION

In accordance with the illustrated preferred embodiment, the present invention provides a apparatus and method for flushing saltwater and/or debris from a marine engine in which control is maintained over both the flow of fluid to the marine engine and the starting of the marine engine.

It is, therefore, an object of the present invention to provide an improved system for flushing saltwater and/or debris from marine engines.

Another object of the present invention is to provide a flushing apparatus and method for controlling both the flow of cleansing fluid to a marine engine and the starting of the marine engine.

It is further an object of the present invention to provide a flushing apparatus and method capable of preventing the wasteful use of cleansing fluid.

Still it is another object of the present invention to provide a flushing apparatus and method which increases the productivity of the operator.

Another object of the present invention is to provide a flushing apparatus and method for reducing the potential for running a marine engine without the necessary coolant.

It is a further object of the present invention to provide a flushing apparatus and method capable of use with either an inboard marine engine or outboard marine engine.

Still it is another object of the present invention to provide a flushing apparatus and method which is easily constructed at a low cost, reliable, and is suitable for use by relatively unskilled personnel.

The present invention has other objects and advantages which are set forth in the Description of the Best Mode of Carrying Out the Invention. The features and advantages described in the specification, however, are not all inclusive, and particularly, many additional features and advantages will be apparent to one of ordinary skill in the art in view of the drawings, specification, and claims herein.

The above objects are achieved by a apparatus and method for flushing a marine engine which controls both the flow of fluid to the marine engine and the starting of the marine engine. The apparatus employs conduit formed at one end for coupling to a fluid supply and formed at another end for coupling to the marine engine to supply fluid to an inlet port of the marine engine; a valve mounted to the conduit between the ends for controlling the flow of fluid from the fluid supply to the inlet port, the valve being responsive to an electrical start signal to open the valve for the flow of fluid in the conduit means from the fluid supply to the inlet port; and a switch assembly electrically coupled to the valve and formed for electrical coupling to the marine engine, the switch assembly being responsive to user input to provide the start signal to the valve to cause the valve to allow fluid to flow from the fluid supply to the marine engine and to provide an engine signal to the marine engine to cause at least one of enabling the marine engine to start and starting of the marine engine.

The method of the present invention includes, briefly, the steps of supplying fluid to the marine engine from a fluid supply; controlling the flow of fluid from the fluid supply to the marine engine using a valve coupled between the fluid supply and the marine engine; activating a switch to generate a start signal; transmitting the start signal to the valve to start the flow of fluid from the fluid supply to the marine engine; and in response to the transmitting step, further communicating an engine supply signal to the marine engine to start the marine engine.

BEST MODE OF CARRYING OUT THE INVENTION

Figure 1:
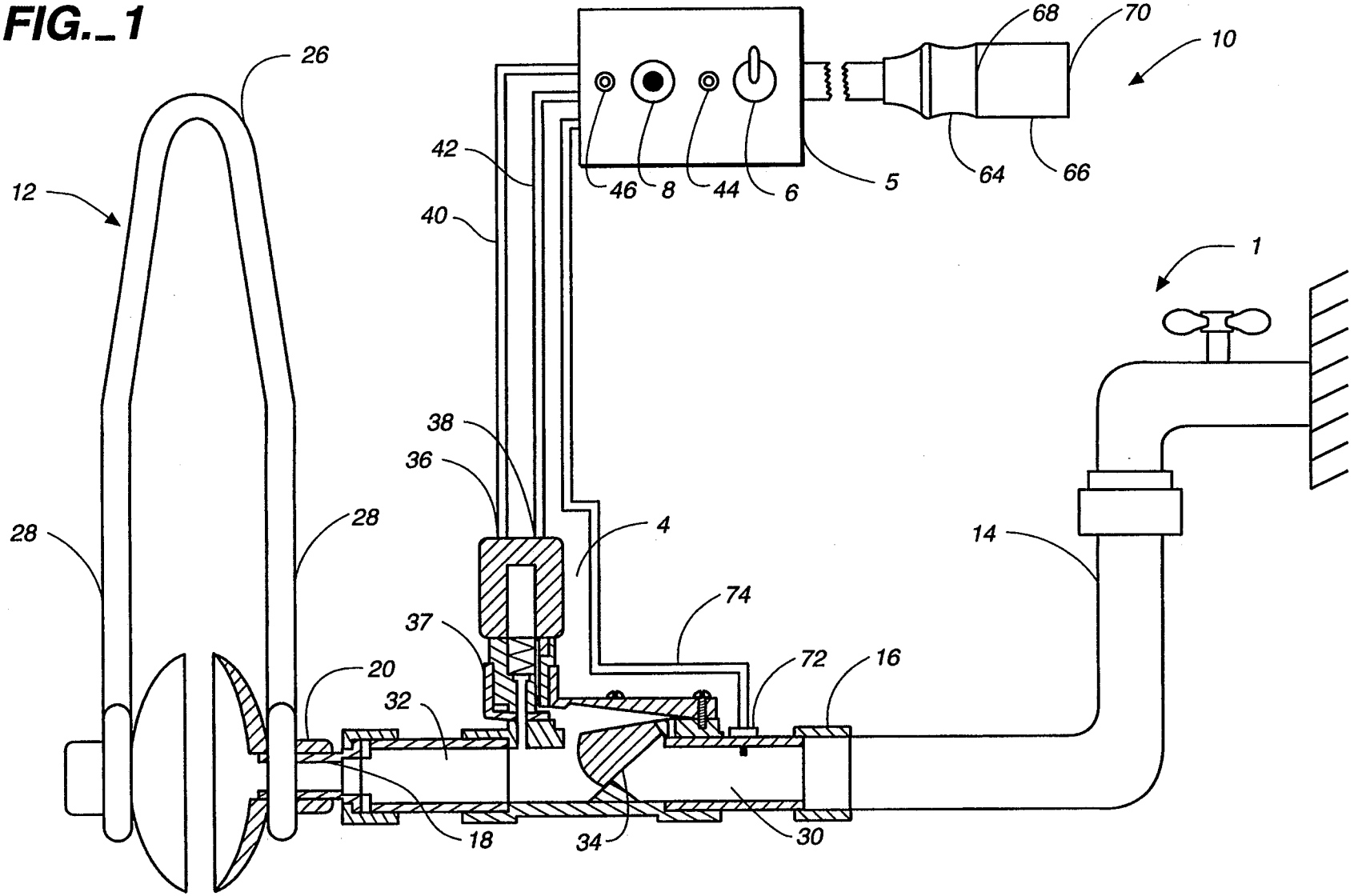
FIG. 1 is a schematic diagram of a flushing apparatus constructed in accordance with the present invention.

The present invention employs a marine engine flushing apparatus and method. FIG. 1 of the drawings depicts the preferred embodiment of the present invention for purpose of illustration only. One skilled in the art will readily recognize from the following discussion that alternative embodiments of the structures and methods illustrated herein may be employed without departing from the principles of the invention described herein.

Referring to FIG. 1, it will be seen that cleansing fluid is supplied from a pressurized fluid supply 1 through the flushing apparatus, generally designated 12, to a cooling inlet port 2 (FIG. 2A) of a marine engine 3. Electronic switches housed in water-resistant compartment 5 control the operation of a solenoid switched valve 4, as well as the operation of marine engine 3. The electronic switches allow a user to control the flow of fluid to marine engine 3 and the starting of marine engine 3 from a single location.

The term "marine engine" is used in this specification to broadly include any type of engine used in the marine environment. This may include, but not limited to, inboard boat engines with and without a stern drive, outboard boat engines, and engines for personal marine propulsion devices, such as jet skis. Outboard engines and inboard engines with stern drives comprise both a motor mechanism and a drive mechanism. In both instances, the cooling inlet ports are found on the drive mechanism. But the fluid supplied via these cooling inlet ports will cleanse both the motor mechanism and drive mechanism. On inboard engines with no stern drive and only a propeller shaft, there is only a motor mechanism. Therefore, cleansing fluid is input directly to the engine mechanism via an inlet in the hull of the boat. Accordingly, the term marine engine is intended to include both marine motor mechanisms and marine drive mechanisms either together or individually.

The preferred embodiment utilizes solenoid switched valve 4 for controlling the flow of cleansing fluid. Coupled to solenoid switched valve 4 is water-resistant compartment 5 housing single-pole double-throw valve switch 6, engine start switch 8, engine electrical coupler 10 and flushing accessory 12 for controlling the operation of solenoid switched valve 4 and marine engine 3. In combination, these components allow for control of both the flow of fluid to the marine engine 3 and the enabling and/or starting of the marine engine 3.

The fluid for cleansing the marine engine 3 is supplied by a pressurized fluid supply 1. For example, a common fresh water spigot may serve as the fluid supply. Fluids other than water may be utilized, such as anti-freeze, for winterizing the marine engine 3. Fluid supply conduit 14, preferably an ordinary water hose, couples the fluid supply to solenoid switched valve 4 using conventional hose couplings. The internally-threaded end of the conventional hose is coupled to the spigot and the externally-threaded end of the conventional hose is coupled to internally-threaded inlet coupling 16.

It would be apparent to one of ordinary skill that any type of piping, tubing or the like made of metal, plastic, rubber or the like may be used as fluid supply conduit 14. Furthermore, solenoid switched valve 4 may be coupled to fluid supply 1 without fluid supply conduit 14 by using coupling of solenoid switched valve 4 and fluid supply 1.

Outlet coupling 18 of solenoid switched valve 4 is coupled to flushing accessory 12 either directly, as shown in FIG. 1, or via an outlet conduit such as an ordinary hose. Coupling 18 is externally-threaded for attachment to any type of flushing accessory 12 equipped with a conventional hose coupling illustrated as flushing accessory inlet coupling 20.

Numerous types of flushing accessories are available for attachment to either inboard or outboard marine engines. A representative sample of these are described above in the Background section. One of ordinary skill would recognize that any type of flushing accessory, described above or elsewhere, may be easily substituted for flushing accessory 12 depicted in FIG. 1.

Figure 2A:
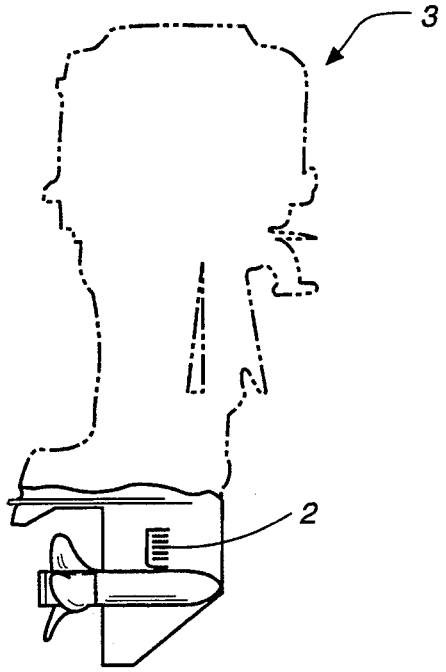
FIG. 2A is a side elevation view of a marine engine without a flushing accessory attached.
Figure 2B:
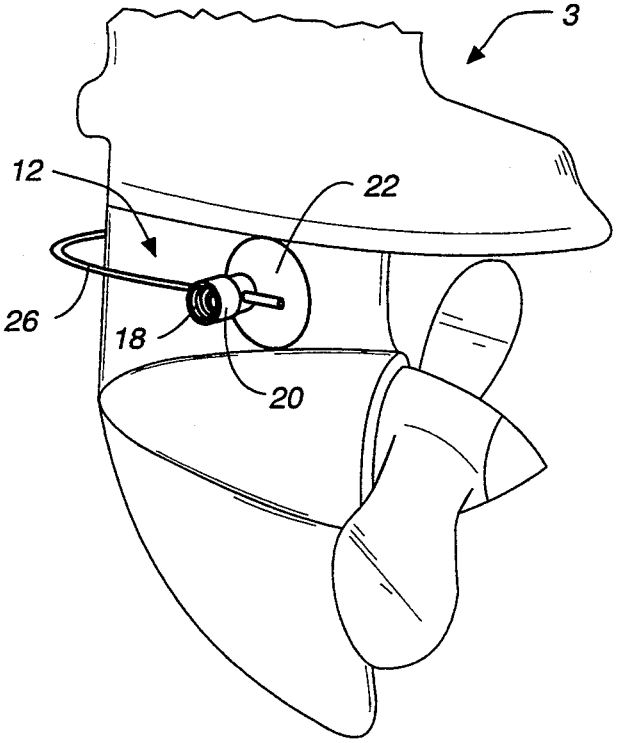
FIG. 2B is an enlarged, fragmentary side elevation view of the opposite side of FIG. 2A showing a flushing accessory of the type illustrated in FIG. 1 attached thereto.

FIGS. 2A and 2B show marine engine 3 without and with flushing accessory 12 attached, respectively.

Flushing accessory 12 comprises flushing accessory inlet coupling 20, input suction cup 22, capping suction cup 24 and U-shaped resilient clamping member 26. Suction cups 22 and 24 are each attached to one of the ends 28 of clamping member 26. Clamping member 26 holds suction cups 22 and 24 in place when attached to the marine engine cooling inlet port 2, as shown in FIG. 2B. Cup 24 caps or closes the port on the opposite side of the engine. Cleansing fluid is supplied to the cooling inlet port 2 covered by input suction cup 22 via water flowing into input suction cup 22 from flushing accessory inlet coupling 20.

Solenoid switched valve 4 is commercially available in most irrigation supply stores. For instance, the 700 series solenoid switched valve sold by Hardie Irrigation may be used in the present invention. U.S. Pat. No. 4,336,918 to Carbo, issued Jun. 29, 1982, describes the subject matter of the Hardie Irrigation valve and is herein incorporated by reference. In general, solenoid switched valves include inlet conduit 30, outlet conduit 32 and valve element 34 for restricting the flow of fluid from inlet conduit 30 to outlet conduit 32. The opening and closing of valve element 34 is controlled by solenoid assembly 37 which has a positive valve electrical lead 36 and negative valve electrical lead 38.

In the present invention, inlet conduit 30 of solenoid switched valve 4 is coupled by inlet coupling 16 to fluid supply conduit 14 for supplying cleansing fluid from the pressurized fluid supply 1. Outlet conduit 32 is coupled to flushing accessory inlet coupling 20 by valve outlet coupling 18 for supplying fluid to the marine engine 3 when valve element 34 is open. Valve electrical leads 36 and 38 are coupled to the switches in water-resistant compartment 5 for controlling the opening and closing of valve element 34.

Electrical switches 6 and 8 housed in water-resistant compartment 5 are electrically coupled to the marine engine 3 via engine electrical coupler 10 for controlling the starting of the marine engine 3 and for providing power to solenoid switched valve 4. Mounted on water-resistant compartment 5 are indicator lights 44 and 46 for indicating the on/off status of valve switch 6 and whether power is available, respectively.

Figure 3A:
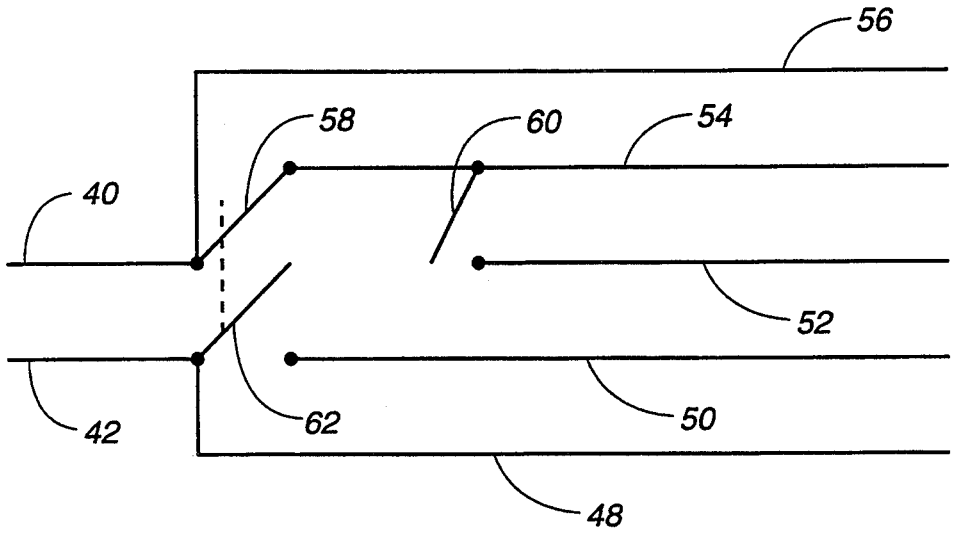
FIGS. 3A and 3B are schematic diagrams of the switch assembly circuit constructed in accordance with the present invention shown in the "on" and "off" positions, respectively.
Figure 3B:
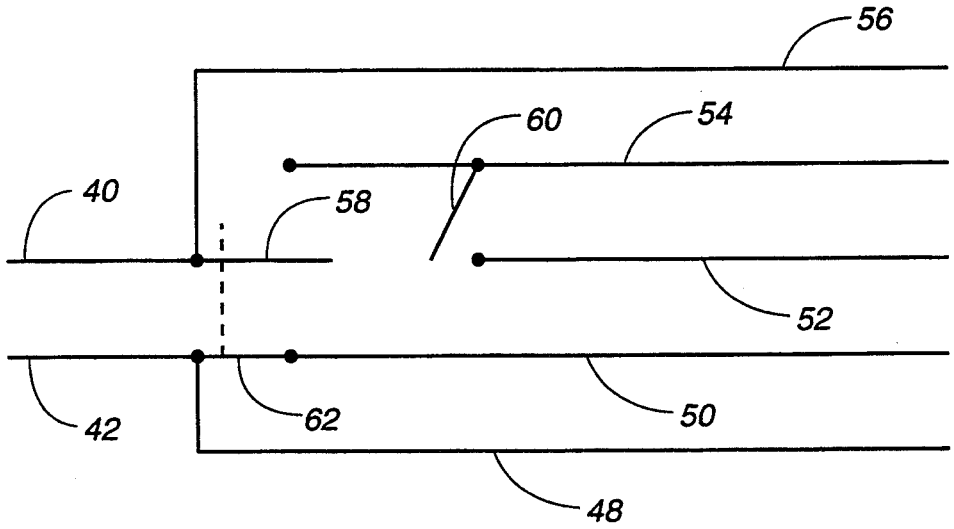

FIGS. 3A and 3B show in detail the internal pole and switch connections in valve switch 6 and engine start switch 8 (shown in FIG. 1). FIGS. 3A and 3B are identical except that FIG. 3A depicts valve switch 6 in the "on" position, and FIG. 3B depicts valve switch 6 in the "off" position. In both FIGS. 3A and 3B, valve electrical line 40 is electrically coupled to positive valve electrical lead 36. Extending from and connected to valve electrical line 42 are negative valve lead 38 and ground line 48 which in turn is coupled to ground on marine engine 3. Thus, negative valve lead 38 is permanently coupled to ground regardless of the position of valve switch 6. Negative ignition line 50 is coupled to the negative terminal on the marine engine ignition coil which enables grounding of the negative ignition coil terminal dependent on the position of valve switch 6. Coupled to the marine engine starter is starter line (52) for supplying a voltage to the starter dependent on the position of valve switch 6. The voltage supply is provided by the positive terminal of the marine engine battery which is coupled to valve switch 6 via voltage supply line 54. Also dependent on the position of valve switch 6 is the supply of power to the positive terminal of the marine engine ignition coil which is coupled to positive ignition line 56.

When valve switch 6 is in the "on" position, as depicted in FIG. 3A, valve electrical line 40 and positive ignition line 56 are coupled to voltage supply line 54 by switch arm 58. This accomplishes two separate tasks. First, solenoid switched valve 4 is energized by the voltage supplied from the marine engine battery. As a result, valve element 34 is moved to the open position to allow fluid to flow from valve inlet conduit 30 to valve outlet conduit 32 and ultimately into the cooling inlet port 2 on the marine engine 3. Second, a voltage is supplied to the positive lead of the marine engine ignition coil via positive ignition line 56. This enables the ignition coil of the marine engine 3 for starting once the marine engine starter is engaged. If a voltage is not supplied to the ignition coil when the starter is engaged, the marine engine 3 will not start.

Once a voltage is supplied to the ignition coil of the marine engine 3, engine start switch 8 can be engaged to start the marine engine 3. Engaging engine start switch 8 causes engine switch arm 60 to contact starter line 52. Since engine switch arm 60 is permanently connected to voltage supply line 54, contacting engine switch arm 60 to starter line 52 supplies a voltage to the marine engine starter. The voltage engages the solenoid in the marine engine starter to start the marine engine 3. Engine start switch 8 is preferably a momentary switch. Therefore, engine switch arm 60 remains in contact with starter line 52 long enough for the marine engine starter to start the marine engine 3 and then disengages contact with starter line 52.

When valve switch 6 is in the "off" position, as depicted in FIG. 3B, valve switch arm 58 is not in contact with voltage supply line 54. Accordingly, no voltage is supplied to either solenoid switched valve 4 along valve electrical line 40 or to the marine engine ignition coil along positive ignition line 56. However, valve switch arm 62 is in contact with negative ignition line 50. Although solenoid switched valve 4 is permanently coupled to ground via valve electrical line 42 and ground line 48, the negative terminal of the marine engine ignition coil is also grounded. As a result, the marine ignition coil is shorted by cutting off the supply voltage and connecting the ignition coil to ground.

If engine start switch 8 is enabled, thereby supplying a voltage to the marine engine starter as described above, the marine engine 3 will not start. This result is accomplished since valve switch arm 58 is not in contact with supply line 54 while valve switch 6 is in the "off" position. Although the marine engine 3 is not started, another benefit is achieved. Marine engine 3 turns over without starting which is useful during certain repairs such as valve and timing adjustments.

FIG. 1 shows electrical lines 48 through 56 electronically coupled to the marine engine 3 by electrical coupler 10, which is in the form of a connector plug for use with marine engines equipped with a female counterpart, i.e. receptacle or socket. As shown, electrical coupler 10 comprises universal connector plug 64 and dedicated plug adapter 66. Switch end 68 of dedicated plug adapter 66 is coupled to universal connector plug 64. Engine end 70 of dedicated plug adapter 66 is configured for coupling to particular types of marine engines.

Accordingly, a user may be able to purchase multiple dedicated plug adapters 66 each with a different engine end 70 for connection to a particular type of engine. The switch end 68 on all dedicated plug adapters 66 will be identical for coupling to universal connector plug 64. It will be apparent to one of ordinary skill that standard dedicated connector plugs may be used in place of universal connector plug 64 and dedicated plug adapter 66. However, these dedicated connector plugs will not have the versatility of the electrical coupler 10 shown in FIG. 1.

Alternatively, standard alligator-type electrical clips may be used thereby eliminating the need for any type of plug. Electrical lines 48 through 56 are each connected to an individual alligator-type clip. In turn, the alligator-type clips are connected to the corresponding engine components (ground, starter, ignition coil and battery).

In some outboard engines, particularly 50 to 110 horsepower engines, during normal use the marine battery is coupled to the outboard engine via the connector plug receptacle on marine engine 3. Thus, no power is supplied to marine engine 3 when universal connector plug 64 is coupled to the connector plug receptacle on marine engine 3. This problem is remedied by coupling, through means other than universal connector plug 64, voltage supply line 54 to the positive terminal of the marine battery and coupling ground line 48 to either the negative terminal of the marine battery or to ground. These couplings are achieved by connecting a wire to voltage supply line 54 and a wire to ground line 48 inside water-resistant compartment 5. The wires extend from water-resistant compartment 5 with alligator clips connected to the ends for coupling to the marine battery and/or ground.

In an alternative embodiment, water-resistant compartment 5, the switches contained therein and electrical coupler 10, may simply be replaced by a pair of alligator clips. The first alligator clip is electrically coupled to the ground on the marine engine 3 and the second alligator clip is electrically coupled to the positive lead on the marine engine ignition coil. The regular key switch normally used to start the marine engine 3 acts as a switch assembly for the entire flushing apparatus and is electrically coupled to both the marine engine 3 and solenoid switched valve 4, thus replacing valve switch 6 and engine start switch 8. When a user utilizing this configuration turns the key switch on, the marine engine 3 is started. As a result, a positive voltage will appear at the positive lead of the marine engine ignition coil which is coupled by the second alligator clip and valve electrical line 40 to solenoid switched valve 4. Consequently, solenoid switched valve 4 will open to allow the flow of fluid simultaneously with the starting of the engine.

Figure 4:
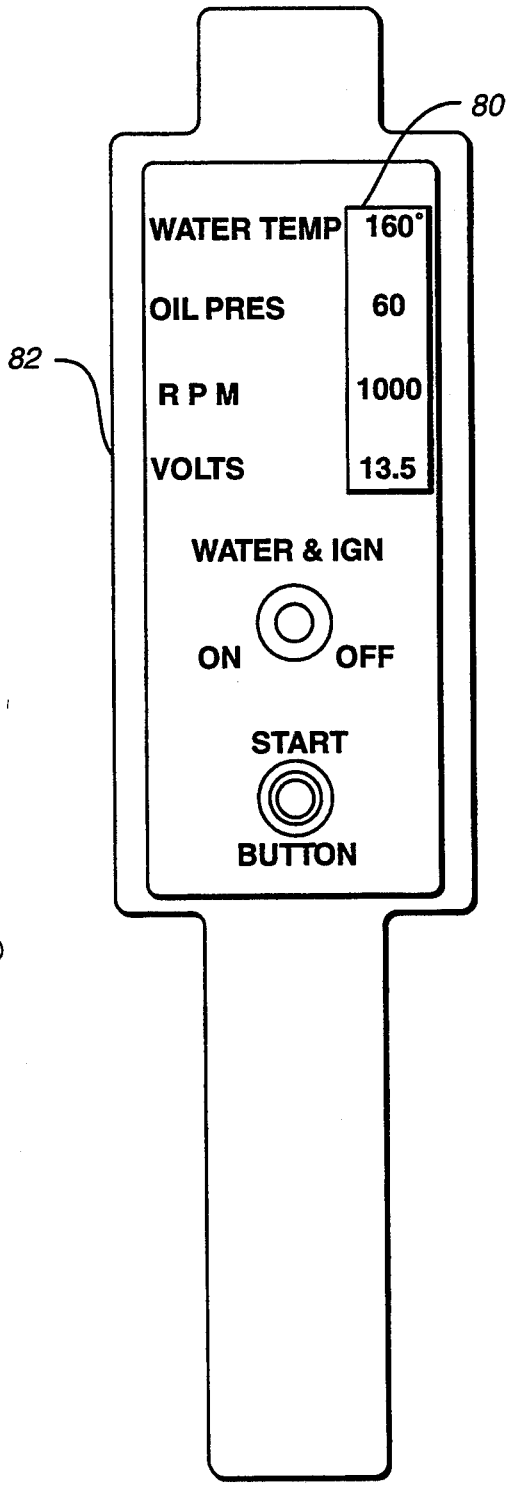
FIG. 4 is a top plan view of an alternate embodiment of the water-resistant compartment illustrated in FIG. 1.

In another alternate embodiment, engine condition display 80 is coupled to the face of water-resistant compartment 82, as shown in FIG. 4. The switching circuitry contained in water-resistant compartment 82 is identical to the circuitry in water-resistant compartment 5 shown in FIGS. 3A and 3B except additional electrical lines are included for carrying the engine condition information from marine engine 3 via engine electrical coupler 10. The engine condition information, which includes water temperature, oil pressure, RPM, voltage level and the like, is displayed on display 80. The availability and easy accessibility of the engine condition information is helpful to the user when tuning the engine and as a tool for testing the marine engine condition information sending unit and gauges.

It will be apparent to one of ordinary skill that other alternative embodiments are possible. In particular, as shown in FIG. 1, water pressure sensor 72 is added between fluid conduit 14 and solenoid switched valve 4 to sense the presence of fluid in the valve inlet conduit 30. This would indicate that the fluid supply is flowing, so that if solenoid switched valve 4 is opened, fluid will flow into the cooling inlet port 2 of the marine engine 3.

Fluid pressure sensor 72 is coupled to negative ignition line 50 by sensor line 74 to ground the ignition coil if no fluid is present in inlet conduit 30. This disables marine engine 3 by turning off marine engine 3, if operating, and preventing it from starting. Thus, the user would be prevented from accidentally starting the marine engine 3 without fluid flowing into the cooling inlet port 2. As a result, the chance of damaging the marine engine 3 by operating it without cooling fluid is eliminated.

In operation, the user first starts the flow of fluid from the fluid supply, for example by opening the water spigot coupled to fluid supply conduit 14. Then, a user first switches valve switch 6 to the "on" position. Valve switch indicator light 44 illuminates to indicate valve switch 6 is in the "on" position. As a result, valve switch arm 58 contacts voltage supply line 54, thereby supplying a voltage via valve electrical line 40 to solenoid switched valve 4. The voltage supplied to solenoid switched valve 4 causes valve element 34 to open, allowing fluid to flow from the fluid supply via fluid supply conduit 14 through valve conduits 30, 32 and into the cooling inlet port 2 of the marine engine 3 via flushing accessory 12.

Once the user has switched valve switch 6 to the "on" position, the user activates engine start switch 8, for example by depressing a button on water-resistant compartment 5. This action will cause engine switch arm 60 to contact starter line 52. As a result, a voltage is supplied from voltage supply line 54 to the marine engine starter. This turns on the marine engine 3 and allows it to continue running while fluid is continually flowing through the marine engine 3.

From the above description, it will be apparent that the invention disclosed herein provides a novel and advantageous marine engine flushing apparatus and method. The foregoing discussion discloses and describes merely exemplary methods and embodiments of the present invention. One skilled in the art will readily recognize from such discussion that various changes, modifications and variations may be made therein without departing from the spirit and scope of the invention. Accordingly, disclosure of the present invention is intended to be illustrative, but not limiting, of the scope of the invention, which is set forth in the following claims.

I claim:

1. A flushing apparatus for a marine engine having at least one cooling inlet port, comprising:

conduit means formed at one end for coupling to a fluid supply and formed at another end for coupling to said marine engine to supply fluid to an inlet port of said marine engine;

a valve assembly mounted to said conduit means between the ends for controlling the flow of fluid from said fluid supply to said inlet port, said valve assembly being responsive to an electrical start signal to open said valve assembly for the flow of fluid in said conduit means from said fluid supply to said inlet port; and a switch assembly electrically coupled to said valve assembly and formed for electrical coupling to said marine engine, said switch assembly being responsive to user input to provide said start signal to said valve assembly to cause said valve assembly to allow fluid to flow from said fluid supply to said marine engine and to provide an engine signal to said marine engine to cause at least one of enabling said marine engine to start and starting of said marine engine.

2. The flushing apparatus recited in claim 1, further comprising:

an engine flushing accessory coupled to said another end of said conduit and formed for supply of fluid to said inlet port.

3. The flushing apparatus recited in claim 2, wherein said engine flushing accessory includes a self-gripping clamp.

4. The flushing apparatus recited in claim 1, wherein said valve assembly is a solenoid switched valve assembly electrically connected to said switch assembly.

5. The flushing apparatus recited in claim 1, further comprising:

a universal plug electrically coupled to said switch assembly; and a dedicated plug adapter electrically coupled to said universal plug and formed for coupling of said universal plug to a socket on any of a plurality of socket types on said marine engine.

6. The flushing apparatus recited in claim 1, wherein said one end of said conduit means is coupled to a water supply.

7. The flushing apparatus recited in claim 1, wherein said switch assembly comprises valve assembly switch for generating said start signal and an engine start switch for generating said engine signal.

8. The flushing apparatus recited in claim 8, wherein said engine start switch is a momentary switch.

9. The flushing apparatus recited in claim 1, further including a display for displaying at least one condition of said marine engine.

10. A method of flushing a marine engine, comprising the steps of:

supplying fluid to said marine engine from a fluid supply;

controlling the flow of fluid from said fluid supply to said marine engine using a valve assembly coupled between said fluid supply and said marine engine;

activating a switch to generate a start signal;

transmitting said start signal to said valve assembly to start the flow of fluid from said fluid supply to said marine engine; and in response to said transmitting step, further communicating an engine signal to said marine engine to start said marine engine.

11. The flushing method recited in claim 11, wherein said step of transmitting said start signal to said valve assembly starts the flow of fluid to said marine engine by energizing said valve assembly.

12. The flushing method recited in claim 11, further including the step of;

displaying at least one condition of said marine engine.

* * * * *